US012710235B2

(12) United States Patent
Sorbel et al.

(10) Patent No.: US 12,710,235 B2
(45) Date of Patent: Aug. 18, 2026

(54) OPTICAL TRANSITIONAL SWITCH

(71) Applicant: Raytheon Company, Tewksbury, MA (US)

(72) Inventors: Scott Randall Sorbel, Manhattan Beach, CA (US); Tuan L. Duong, Santa Barbara, CA (US); Kurt S. Ketola, El Segundo, CA (US); Jesus Gerardo Vera, McKinney, TX (US)

(73) Assignee: RAYTHEON COMPANY, Tewksbury, MA (US)

( * ) Notice: Subject to any disclaimer, the term of this patent is extended or adjusted under 35 U.S.C. 154(b) by 176 days.

(21) Appl. No.: 18/816,443

(22) Filed: Aug. 27, 2024

(65) Prior Publication Data

US 2026/0063378 A1 Mar. 5, 2026

(51) Int. Cl.
*F28F 1/00* (2006.01)
*C25D 1/00* (2006.01)

(52) U.S. Cl.
CPC ..... *F28F 1/006* (2013.01); *C25D 1/003* (2013.01); *C25D 1/006* (2013.01)

(58) Field of Classification Search
CPC ..... C25D 1/003; C25D 1/006; F28F 1/006
See application file for complete search history.

(56) References Cited

U.S. PATENT DOCUMENTS 10,122,062 B1 11/2018 Sorbel et al.
10,983,047 B2 4/2021 Padilla et al.
2019/0302325 A1 10/2019 Sorbel et al.
2023/0105985 A1* 4/2023 Teng ..... G02F 1/055 359/318
2025/0012513 A1* 1/2025 Meczkowski ..... B33Y 80/00

FOREIGN PATENT DOCUMENTS

CN 116722372 A 9/2023
CN 120143323 A 6/2025

OTHER PUBLICATIONS

US 2025/0093345 A1, 03/2025, Mazed (withdrawn)*
International Search Report with Written Opinion issued in International Application No. PCT/US2025/043097; Date of Mailing Nov. 13, 2025 (15 pages).
Li et al. "Recent advances in vanadium dioxide for dynamic thermal radiation modulation: A review" Solar Energy Materials and Solar Cells 275 (Sep. 2024) 113040 (15 pages).
Yang et al. "Experimental realization of three-dimensional indefinite cavities at the nanoscale with anomalous scaling laws" Nature Photonics 6.7 (Jul. 2012) pp. 450-454.

* cited by examiner

*Primary Examiner* — Nelson J Nieves
(74) *Attorney, Agent, or Firm* — CANTOR COLBURN LLP

(57) ABSTRACT

A hyperbolic metamaterial is provided. The hyperbolic metamaterial includes a substrate and sub-wavelength nanostructures arrayed on the substrate. Each sub-wavelength nanostructure has a decreasing cross-sectional area with increasing height from the substrate and includes dielectric or semi-metallic material layers and metal-insulator transition (MIT) material layers respectively interleaved with the dielectric or semi-metallic material layers. Each MIT material layer and each dielectric or semi-metallic material layer of each sub-wavelength nanostructure has a cross-sectional shape characterized in that current is induced in one or both of the dielectric or semi-metallic material layers and the MIT material layers by exposure to a magnetic field.

20 Claims, 7 Drawing Sheets

Step 1-Wafer Prep

Step 2

- Deposit Positive/Negative Photoresist

Step 3

- Deposit VO2

Step 4

- Lift Off
- One Layer Complete

Step 5

- Repeat Steps 2,3 And 4 10 Times With Ever Changing Mask Designs
- Vo2 Layer Deposited Thickness=10 nm
- BaF2 Layer Deposited Thickness=2 um
- Total Stack Up Height Is~20.2 um Step 6

- Final Lift Off
- Cleaning
- Dice Wafer Samples

OPTICAL TRANSITIONAL SWITCH

BACKGROUND

The present disclosure relates to optical transitional switches and, in particular, to a hyperbolic optical transitional transition switch for absorbing uniaxial converting emissivity.

Electromagnetic (EM) metasurfaces have been used in applications dealing with reflection spectra of subwavelength metallic gratings which had shown dark areas. This unusual effect led to the discovery of surface plasmon polariton (a particular EM wave excited at metal/dielectric interfaces). In addition, subwavelength-thick films can also produce dramatic changes in EM boundary conditions. Metasurfaces can refer to concepts in the microwave spectrum such as frequency selective surfaces (FSS), impedance sheets and Ohmic sheets. For EM waves in the microwave regime, thicknesses of metasurfaces can be much smaller than the wavelength of operation (for example, 1/1000 of the wavelength), since skin depth could be extremely small for highly electrically conductive metals.

SUMMARY

According to an aspect of the disclosure, a hyperbolic metamaterial is provided. The hyperbolic metamaterial includes a substrate and sub-wavelength nanostructures arrayed on the substrate. Each sub-wavelength nanostructure has a decreasing cross-sectional area with increasing height from the substrate and includes dielectric or semi-metallic material layers and metal-insulator transition (MIT) material layers respectively interleaved with the dielectric or semi-metallic material layers. Each MIT material layer and each dielectric or semi-metallic material layer of each sub-wavelength nanostructure has a cross-sectional shape characterized in that current is induced in one or both of the dielectric or semi-metallic material layers and the MIT material layers by exposure to a magnetic field.

In accordance with additional or alternative embodiments, the hyperbolic metamaterial exhibits first emissivity and reflective behavior at first temperatures and second emissivity exceeding the first emissivity at second temperatures exceeding the first temperatures.

In accordance with additional or alternative embodiments, each MIT material layer and each dielectric or semi-metallic material layer of each sub-wavelength nanostructure has a split-C cross-sectional shape and each sub-wavelength nanostructure has a similar orientation.

In accordance with additional or alternative embodiments, each MIT material layer and each dielectric or semi-metallic material layer of each sub-wavelength nanostructure has a split-C cross-sectional shape and the sub-wavelength nanostructures have random orientations.

In accordance with additional or alternative embodiments, each MIT material layer and each dielectric or semi-metallic material layer of each sub-wavelength nanostructure has a horseshoe cross-sectional shape and each sub-wavelength nanostructure has a similar orientation.

In accordance with additional or alternative embodiments, each MIT material layer and each dielectric or semi-metallic material layer of each sub-wavelength nanostructure has a horseshoe cross-sectional shape and the sub-wavelength nanostructures have random orientations.

In accordance with additional or alternative embodiments, MIT material of the MIT material layers includes at least one or more of vanadium oxide, tungsten oxide, titanium dioxide, molybdenum oxide, doped versions of vanadium oxide, tungsten oxide, titanium dioxide and molybdenum oxide, thermochromic materials that undergo a metal-insulator transition and combinations thereof.

According to an aspect of the disclosure, a satellite is provided and includes a heat generating element and a hyperbolic metamaterial provided as a radiative structure disposed in thermal communication with the heat generating element. The hyperbolic metamaterial includes a substrate and sub-wavelength nanostructures arrayed on the substrate. Each sub-wavelength nanostructure has a decreasing cross-sectional area with increasing height from the substrate and includes dielectric or semi-metallic material layers and metal-insulator transition (MIT) material layers respectively interleaved with the dielectric or semi-metallic material layers. Each MIT material layer and each dielectric or semi-metallic material layer of each sub-wavelength nanostructure has a cross-sectional shape characterized in that current is induced in one or both of the dielectric or semi-metallic material layers and the MIT material layers by exposure to a magnetic field.

In accordance with additional or alternative embodiments, the heat generating element includes a satellite payload.

In accordance with additional or alternative embodiments, the hyperbolic metamaterial provided as the radiative structure is aimed in a preferential direction.

In accordance with additional or alternative embodiments, the hyperbolic metamaterial exhibits first emissivity and reflective behavior at first temperatures and second emissivity exceeding the first emissivity at second temperatures exceeding the first temperatures.

In accordance with additional or alternative embodiments, each MIT material layer and each dielectric or semi-metallic material layer of each sub-wavelength nanostructure has a split-C cross-sectional shape and each sub-wavelength nanostructure has a similar orientation.

In accordance with additional or alternative embodiments, each MIT material layer and each dielectric or semi-metallic material layer of each sub-wavelength nanostructure has a split-C cross-sectional shape and the sub-wavelength nanostructures have random orientations.

In accordance with additional or alternative embodiments, each MIT material layer and each dielectric or semi-metallic material layer of each sub-wavelength nanostructure has a horseshoe cross-sectional shape and each sub-wavelength nanostructure has a similar orientation.

In accordance with additional or alternative embodiments, each MIT material layer and each dielectric or semi-metallic material layer of each sub-wavelength nanostructure has a horseshoe cross-sectional shape and the sub-wavelength nanostructures have random orientations.

In accordance with additional or alternative embodiments, MIT material of the MIT material layers includes at least one or more of vanadium oxide, tungsten oxide, titanium dioxide, molybdenum oxide, doped versions of vanadium oxide, tungsten oxide, titanium dioxide and molybdenum oxide, thermochromic materials that undergo a metal-insulator transition and combinations thereof.

According to an aspect of the disclosure, a method of forming a hyperbolic metamaterial is provided and includes building up an array of sub-wavelength nanostructures on a substrate. The building up of each sub-wavelength nanostructure includes depositing a dielectric or semi-metallic material layer with a cross-sectional shape characterized in that current is induced in the dielectric or semi-metallic material layer by exposure to a magnetic field, depositing a metal-insulator transition (MIT) material layer on the dielectric or semi-metallic material layer with a similar cross-sectional shape as the dielectric or semi-metallic material layer and successively repeating the depositing of the dielectric or semi-metallic material layer and the depositing of the MIT material layer with each successive layer having a decreased cross-sectional area.

In accordance with additional or alternative embodiments, the cross-sectional shape and the similar cross-sectional shape is a split-C cross-sectional shape and the building up of each sub-wavelength nanostructure includes orienting each sub-wavelength nanostructure similarly or at random.

In accordance with additional or alternative embodiments, the cross-sectional shape and the similar cross-sectional shape is a horseshoe cross-sectional shape and the building up of each sub-wavelength nanostructure includes orienting each sub-wavelength nanostructure similarly or at random.

In accordance with additional or alternative embodiments, MIT material includes at least one or more of vanadium oxide, tungsten oxide, titanium dioxide, molybdenum oxide, doped versions of vanadium oxide, tungsten oxide, titanium dioxide and molybdenum oxide, thermochromic materials that undergo a metal-insulator transition and combinations thereof.

Additional features and advantages are realized through the techniques of the present disclosure. Other embodiments and aspects of the disclosure are described in detail herein and are considered a part of the claimed technical concept. For a better understanding of the disclosure with the advantages and the features, refer to the description and to the drawings.

BRIEF DESCRIPTION OF THE SEVERAL VIEWS OF THE DRAWINGS

For a more complete understanding of this disclosure, reference is now made to the following brief description, taken in connection with the accompanying drawings and detailed description, wherein like reference numerals represent like parts.

DETAILED DESCRIPTION

A metamaterial is a sub-wavelength structure that allows for the control of wave physics. This control may be in the form of changing wave direction as in refraction, typically with the real part of a material parameter, or in attenuation as in absorption, typically with the imaginary part of a material parameter. Metamaterials are made from assemblies of multiple sub-wavelength (e.g., $\lambda/8$ to $\lambda/30$) elements fashioned from composite materials such as metals and dielectrics (e.g., plastics). The materials are usually arranged in repeating and non-repeated patterns at scales that are smaller than the wavelengths of the phenomena they influence. The shape, geometry, size, orientation and placement of metamaterial structures allow for control of acoustic waves, EM waves or any other type of waves by blocking, absorbing, enhancing or bending wave energy.

Typically, hyperbolic sub-wavelength structures have exhibited low performance to grazing angle physics at S-polarization (i.e., H-pol or TE with respect to an incidence plane) where the E-field is orthonormal to the plane of incidence.

Thus, as will be described below, a hyperbolic metamaterial is provided with quasi-wavelength or sub-wavelength nanostructures that include dielectric or semi-metallic layers and metal-insulator transition (MIT) material layers, such as layers of vanadium oxide or doped versions thereof, other similar materials, and/or thermochromic materials and/or combinations thereof, which are respectively interleaved with the dielectric or semi-metallic layers. The quasi-wavelength or sub-wavelength nanostructures have cross-sectional shapes characterized in that current is induced in the dielectric or semi-metallic material layers by exposure to a magnetic field. The incorporation of the MIT material into the quasi-wavelength or sub-wavelength nanostructures serves to increase emissivity performance characteristics as a function of temperature and dual polarization (P-pol, V-pol, TM as well as S-pol, H-pol, TE).

Figure 1A:
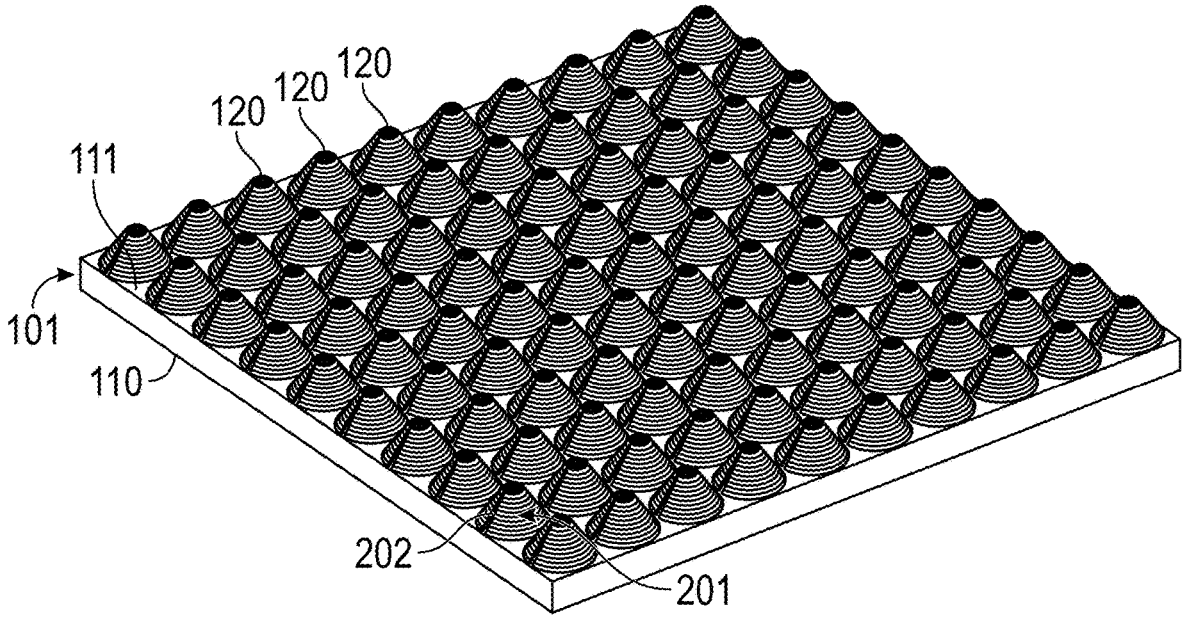
FIG. 1A is a perspective view of a hyperbolic metamaterial with sub-wavelength nanostructures with split-C cross-sectional shapes in similar orientations in accordance with embodiments.
Figure 1B:
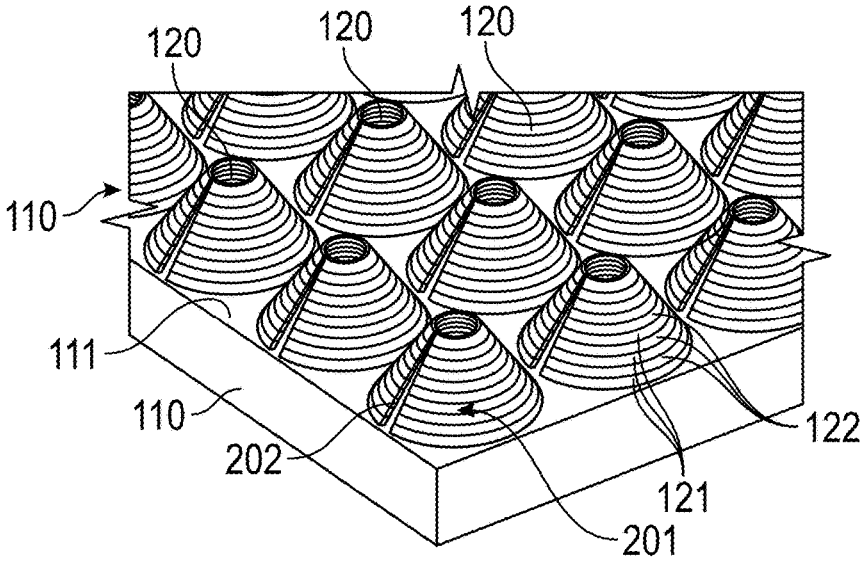
FIG. 1B is an enlarged perspective view of the hyperbolic metamaterial with the sub-wavelength nanostructures with the split-C cross-sectional shapes in similar orientations of FIG. 1A in accordance with embodiments.
Figure 2A:
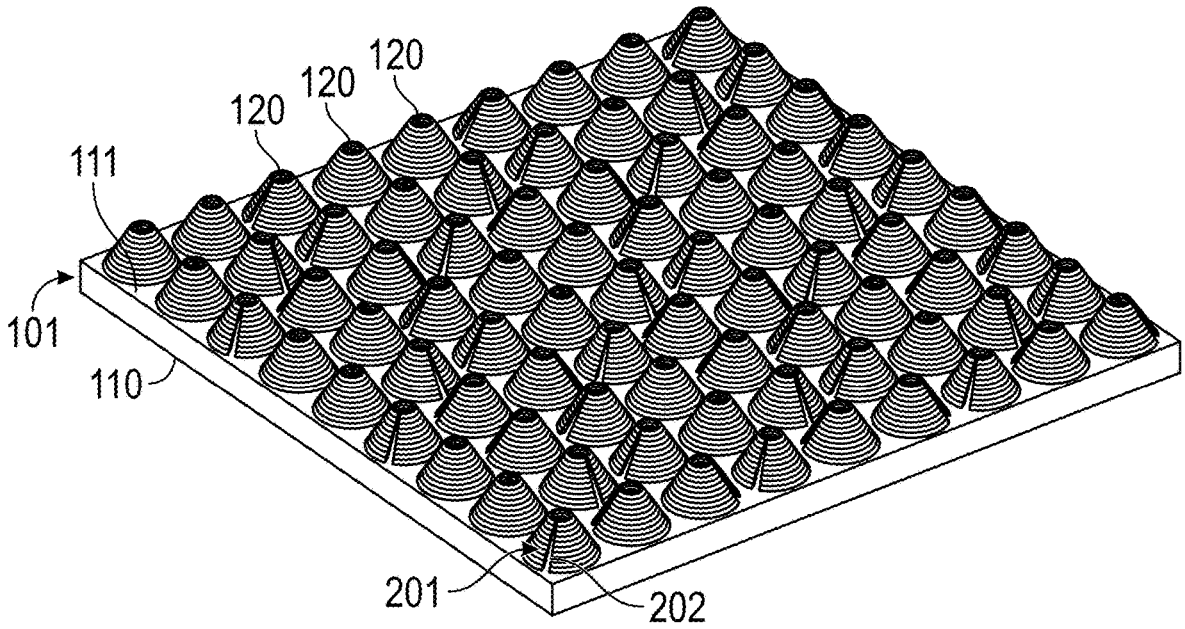
FIG. 2A is a perspective view of a hyperbolic metamaterial with sub-wavelength nanostructures with split-C cross-sectional shapes in random orientations in accordance with embodiments.
Figure 2B:
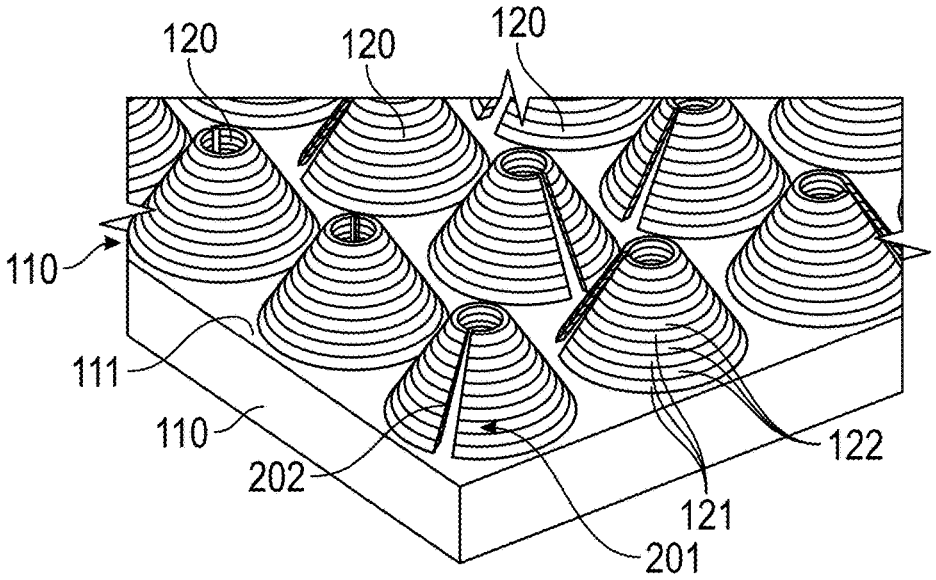
FIG. 2B is an enlarged perspective view of the hyperbolic metamaterial with the sub-wavelength nanostructures with the split-C cross-sectional shapes in random orientations of FIG. 2A in accordance with embodiments.
Figure 3A:
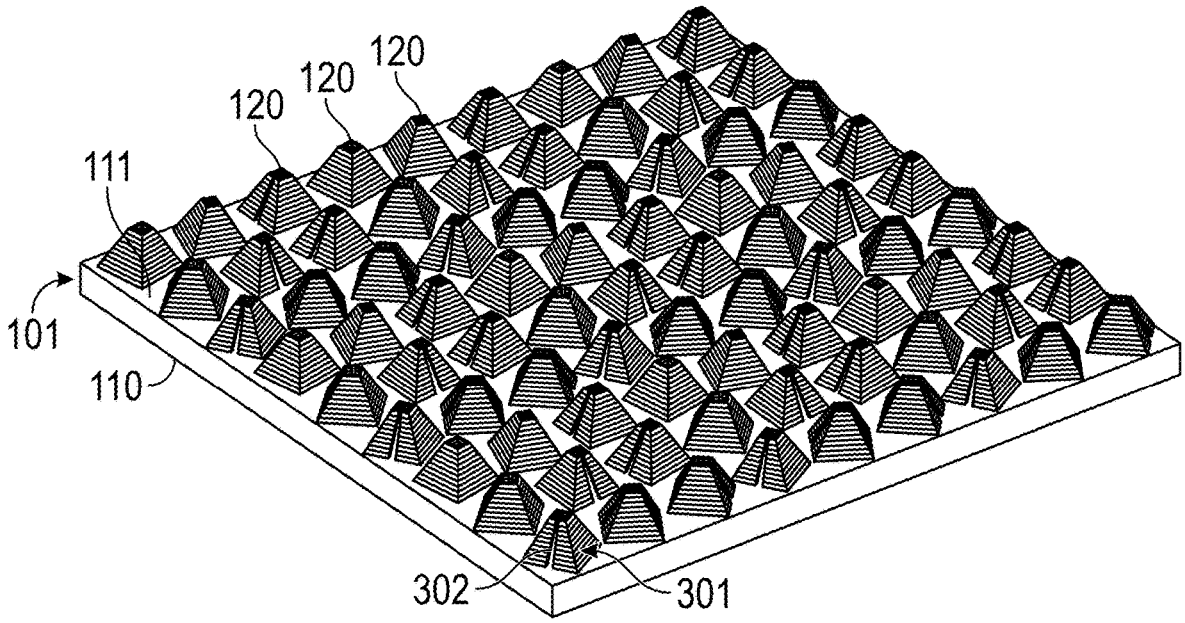
FIG. 3A is a perspective view of a hyperbolic metamaterial with sub-wavelength nanostructures with horseshoe cross-sectional shapes in random orientations in accordance with embodiments.
Figure 3B:
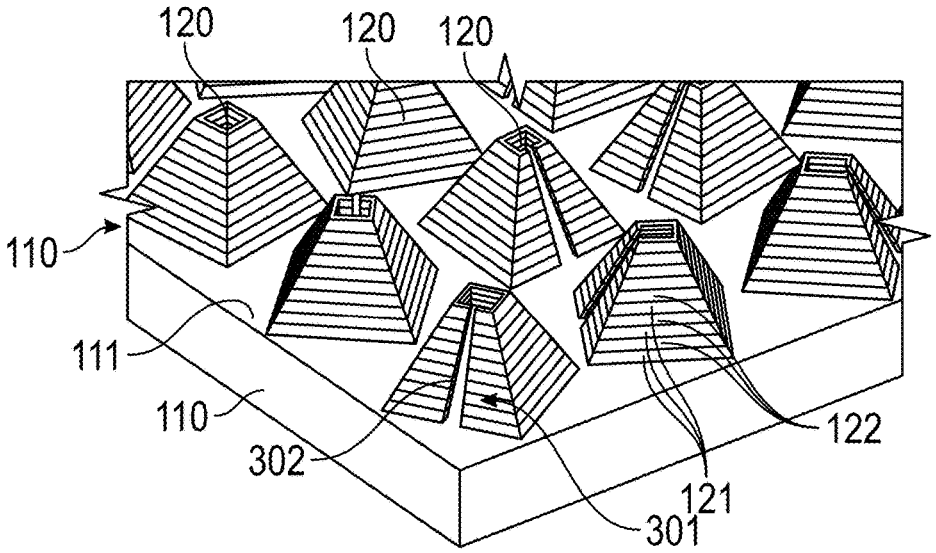
FIG. 3B is an enlarged perspective view of a hyperbolic metamaterial with sub-wavelength nanostructures with horseshoe cross-sectional shapes in random orientations in accordance with embodiments.
Figure 4A:
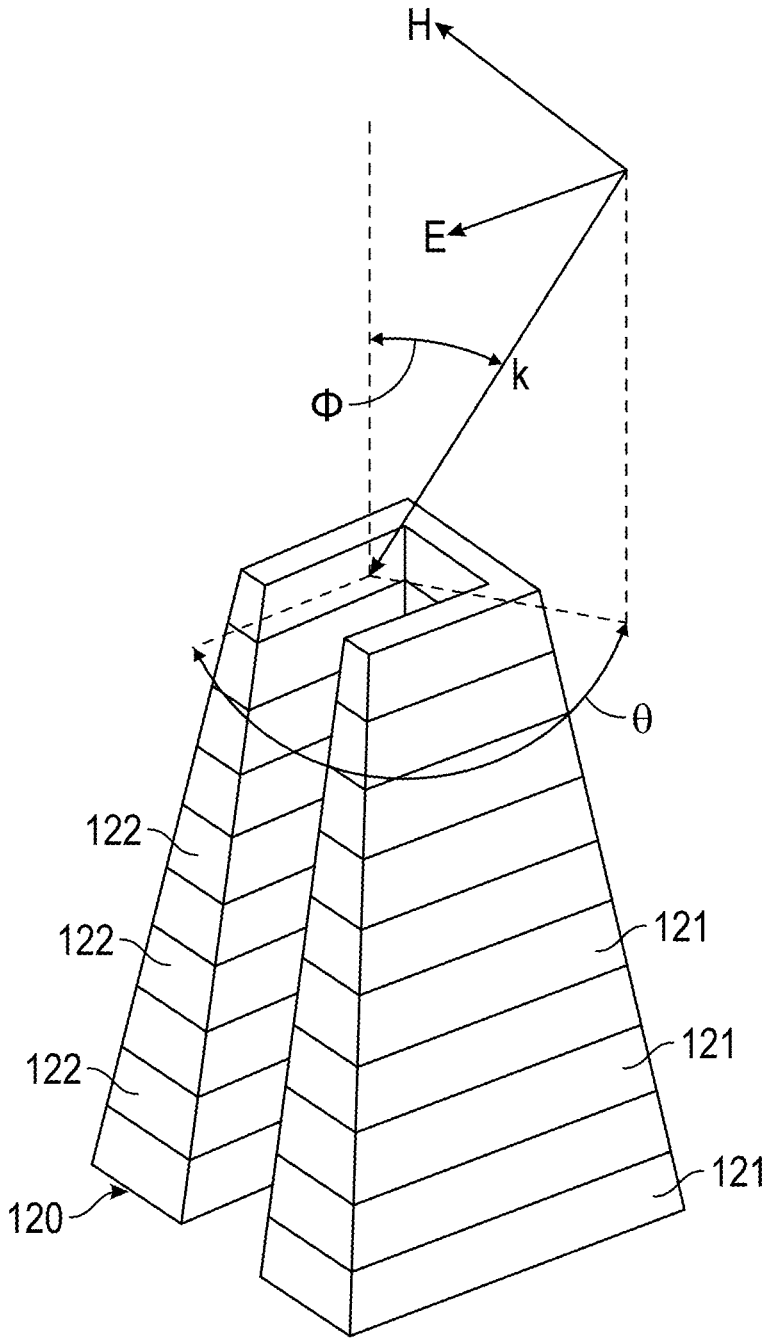
FIG. 4A is a perspective view of a sub-wavelength nanostructure with a horseshoe cross-sectional shape in accordance with embodiments.
Figure 4B:
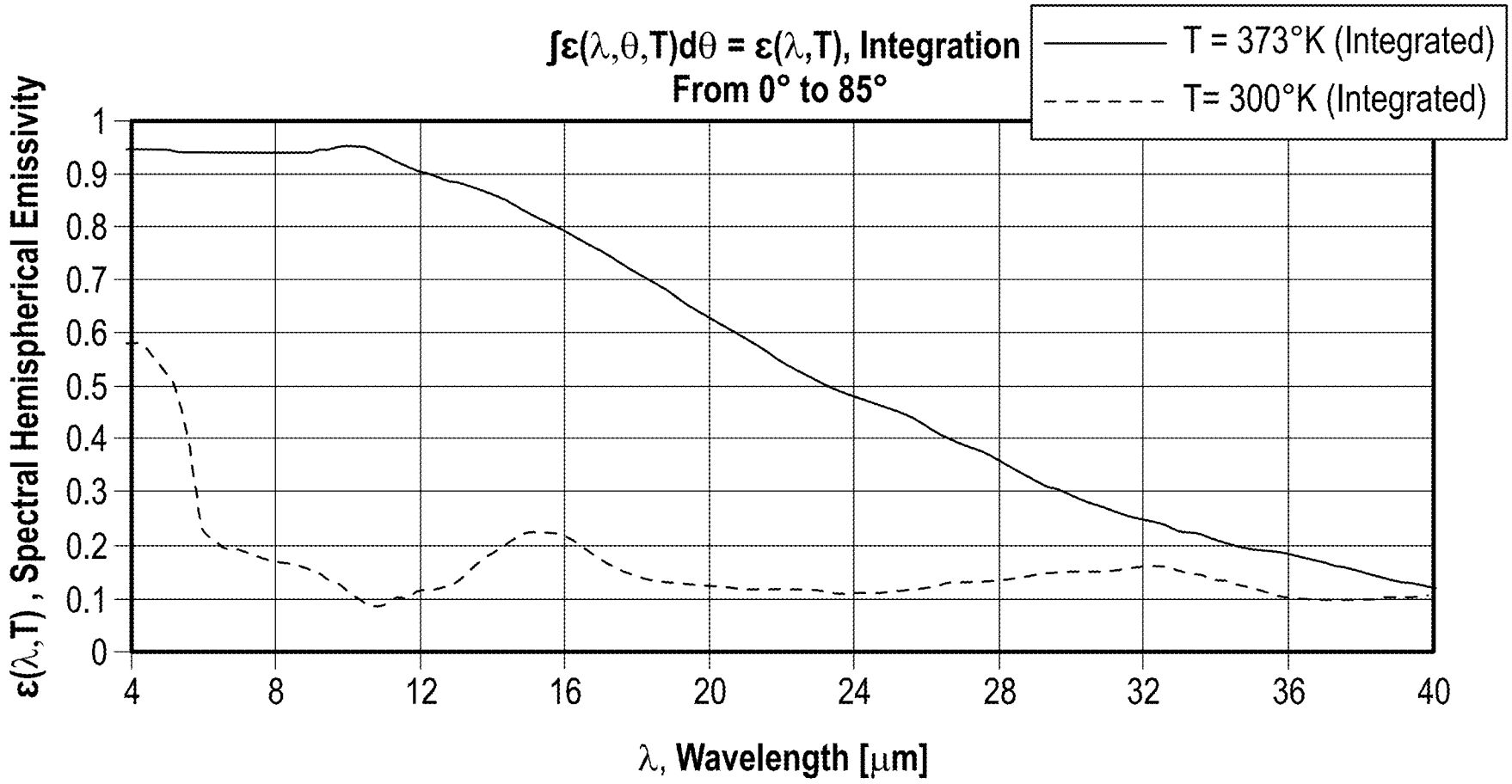
FIG. 4B is a graphical depiction of emissivity performance of the sub-wavelength nanostructure of FIG. 4A in accordance with embodiments.

With reference to FIGS. 1A, 1B, 2A, 2B, 3A and 3B and with additional reference to FIGS. 4A and 4B, a hyperbolic metamaterial 101 is provided. The hyperbolic metamaterial 101 includes a substrate 110 with a surface 111 and multiple sub-wavelength nanostructures 120 that are arrayed on the surface 111 of the substrate 110. Each sub-wavelength nanostructure 120 has a decreasing cross-sectional area as shown in FIG. 4A with increasing height from the surface 111 of the substrate 110. Each sub-wavelength nanostructure 120 includes dielectric or semi-metallic material layers 121 (i.e., materials with high impedance characteristics for example) and metal-insulator transition (MIT) material layers 122 that are each respectively interleaved with the dielectric or semi-metallic material layers 121. For each sub-wavelength nanostructure 120, each MIT material layer 122 and each dielectric or semi-metallic material layer 121 has a cross-sectional shape (i.e., a split-C cross-sectional shape or a horseshoe cross-sectional shape to be described below) that is characterized in that current is induced in one or both of the metallic or dielectric material layers 121 and the MIT material layers 122 by exposure to a magnetic field. A time varying magnetic flux density can induce a time varying magnetic field intensity, which can hence induce the above-noted currents within the hyperbolic metamaterial structure.

FIG. 4A illustrates a wave vector k of an incident EM wave, which is $2\pi/\lambda$, and respective orientations of an E-field and an H-field for the wave vector k. The angle $\Phi$ is an angle between the vector k and a Z-axis (i.e., a height axis of the sub-wavelength nanostructure 120) and the angle $\theta$ is an angle between an X-axis and a plane of incidence in an X-Y plane. A magnetic field vector in the incident EM wave induces a current flow in one or both of the dielectric or semi-metallic material layers 121 and the MIT material layers 122 as the EM wave propagates. Capacitive coupling between opposite ends of the dielectric or semi-metallic material layers 121 and/or between opposite ends of the MIT material layers 122 across the gap allows the one or both of the dielectric or semi-metallic material layers 121 and the MIT material layers 122 to support relatively large resonant wavelengths by producing a large capacitance value that lowers the resonant frequency. An electric field builds up as a result of the charge at the gap that counteracts the current causing energy to be stored in the vicinity of the gap and magnetic field energy concentrated in the region enclosed by the sub-wavelength nanostructure 120.

During operation of the hyperbolic metamaterial 101, the hyperbolic metamaterial 101 exhibits first emissivity (i.e., relatively low emissivity) and reflective behavior at first temperatures ranges (i.e., relatively low temperatures ranges) and second emissivity (i.e., relatively high emissivity) exceeding the first emissivity at second temperatures ranges (i.e., relatively high temperature ranges) exceeding the first temperatures. The differences in the first emissivity and the second emissivity are due at least to the presence of the MIT material layers 122. MIT material of the MIT material layers 122 switches from being an insulator to an electrical conductor upon heating above a critical temperature and can include for example at least one or more of vanadium oxide, tungsten oxide, titanium dioxide, molybdenum oxide, doped versions of vanadium oxide, tungsten oxide, titanium dioxide and molybdenum oxide, thermochromic materials that undergo a metal-insulator transition, other similar materials and/or combinations thereof. Each of these materials undergo similar phase transitions, albeit at different temperatures and with varying degrees of thermal hysteresis and durability. By incorporating the MIT material layers 122 into the sub-wavelength nanostructures 120, emissivity performance characteristics as a function of temperature and dual polarization (i.e., P-pol, V-pol, TM as well as S-pol, H-pol, TE) are increased. This is illustrated in FIG. 4B.

As shown in FIGS. 1 and 2, for each sub-wavelength nanostructure 120, each MIT material layer 122 and each dielectric or semi-metallic material layer 121 has a split-C cross-sectional shape 201 with a gap 202 as noted above and each sub-wavelength nanostructure has a similar orientation as illustrated in FIG. 1 or random orientations as illustrated in FIG. 2. As shown in FIG. 3 (and in FIG. 4A), for each sub-wavelength nanostructure 120, each MIT material layer 122 and each dielectric or semi-metallic material layer 121 has a horseshoe cross-sectional shape 301 with a gap 302 and each sub-wavelength nanostructure has a similar orientation (see FIG. 1) or random orientations as illustrated in FIG. 3.

With the sub-wavelength nanostructures 120 formed with split-C cross-sectional shapes 201 as shown in FIGS. 1 and 2 and/or horseshoe cross-sectional shapes 301 as shown in FIG. 3 the in-plane incident H-field drives in and out of the gap 202/302, induces surface currents and extremely good coupling occurs and leads to increased S-pol emissivity characteristics. In addition, as noted above, the presence of the MIT material layers 122, which are capable of changing electrical conductivity as a function of temperature, offers increased cooling capability for self-cooling panels/systems as described below.

Figure 5:
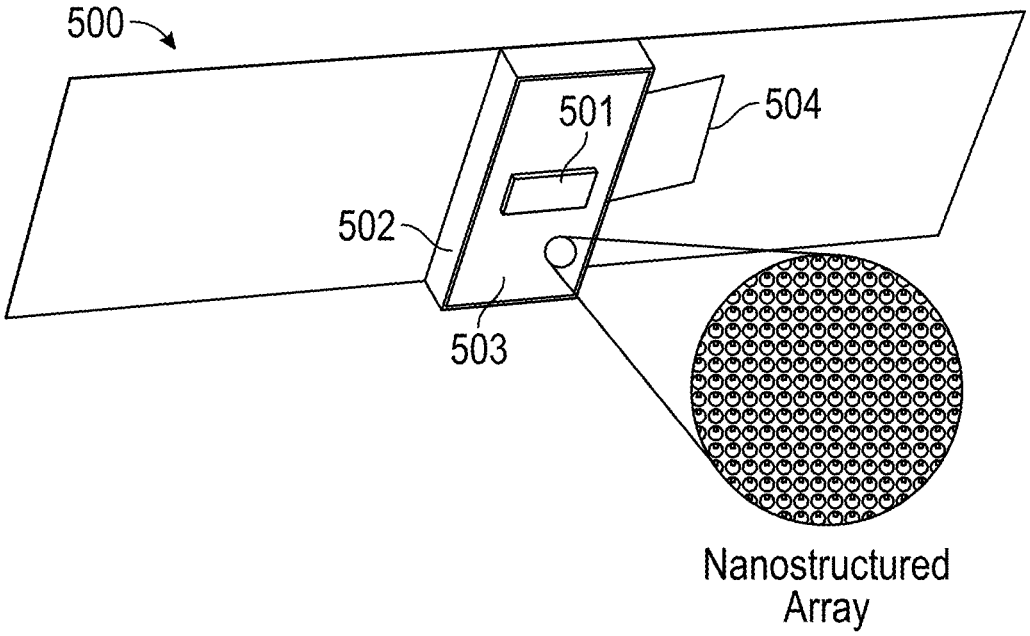
FIG. 5 is a perspective view of a radiative structure including a hyperbolic metamaterial in accordance with embodiments.

With reference to FIG. 5, a radiative structure 503 is provided as a component of, for example, a satellite 500. The satellite 500 includes a heat generating element, such as a satellite payload 501 and a satellite bus 502, and a hyperbolic metamaterial provided as the radiative structure 503, which is disposed in thermal communication with the satellite payload 501 and the satellite bus 502. The radiative structure 503 can be provided as the hyperbolic metamaterial 101 of FIGS. 1-4B. With this configuration, the satellite 500 can exhibit improved self-cooling capability due to the second (or increased) emissivity of the sub-wavelength nanostructures 120 at the second (or relatively high) temperature ranges.

In accordance with embodiments, the improved self-cooling capability of the radiative structure 501 can be exploited by aiming the hyperbolic metamaterial 503 at another component, such as a component 504 that is able to be heated, permanently or temporarily as needed and/or to redirect radiative thermal energy toward a preferential direction. Additionally, by clocking the radiative structure 503, it can also be possible to point emissive energy to a preferential spatial location, such as where a majority of thermal energy is radiated only to one side of a given hemisphere of a body.

Figure 6:
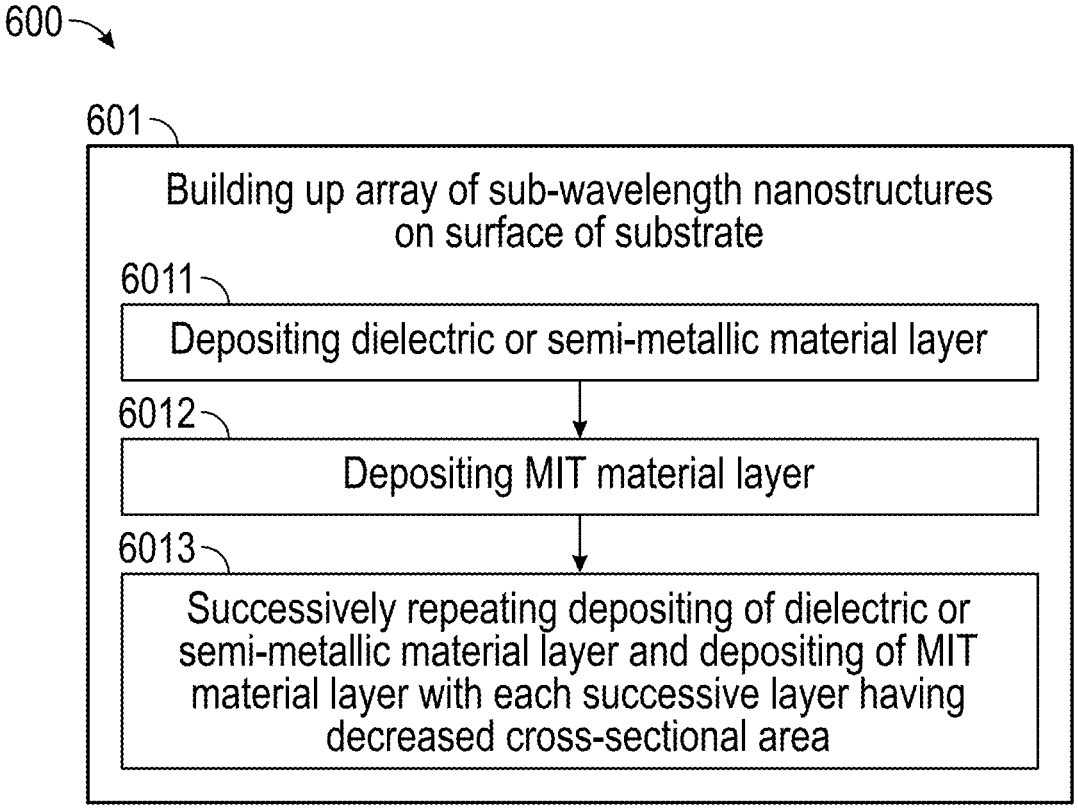
FIG. 6 is a flow diagram illustrating a method of forming a hyperbolic metamaterial in accordance with embodiments.

With reference to FIG. 6, a method 600 of forming a hyperbolic metamaterial, such as the hyperbolic metamaterial 101 of FIGS. 1-4B and the hyperbolic metamaterial of the radiative structure 503 of FIG. 5, is provided. The method 600 includes building up an array of sub-wavelength nanostructures on a substrate (block 601). The building up of each sub-wavelength nanostructure of block 601 includes depositing a dielectric or semi-metallic material layer with a cross-sectional shape characterized in that current is induced in the dielectric or semi-metallic material layer by exposure to a magnetic field (block 6011), depositing a metal-insulator transition (MIT) material layer on the dielectric or semi-metallic material layer with a similar cross-sectional shape as the dielectric or semi-metallic material layer (block 6012) and successively repeating the depositing of the dielectric or semi-metallic material layer and the depositing of the MIT material layer with each successive layer having a decreased cross-sectional area (block 6013). As above, MIT material can include at least one or more of vanadium oxide, tungsten oxide, titanium dioxide, molybdenum oxide, doped versions of vanadium oxide, tungsten oxide, titanium dioxide and molybdenum oxide, thermochromic materials that undergo a metal-insulator transition, other similar materials and/or combinations thereof. Also as above, the cross-sectional shape and the similar cross-sectional shape can be a split-C cross-sectional shape as illustrated in FIGS. 1 and 2 and/or a horseshoe cross-sectional shape as illustrated in FIG. 3 and the building up of each sub-wavelength nanostructure of block 601 can include orienting each sub-wavelength nanostructure similarly or at random.

Figure 7:
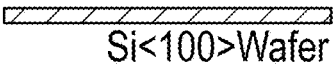
FIG. 7 is a diagram graphically illustrating processes of the method of FIG. 6 in accordance with embodiments.
Figure 7:
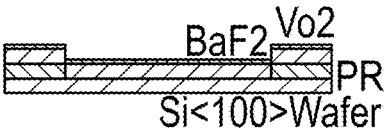
Figure 7:
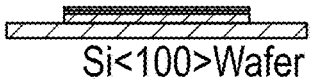
Figure 7:
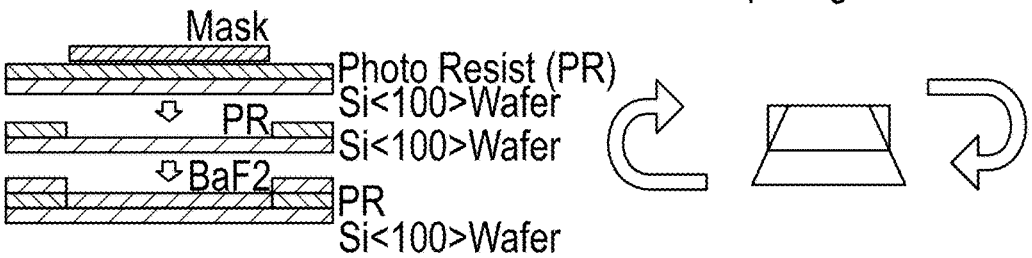
Figure 7:
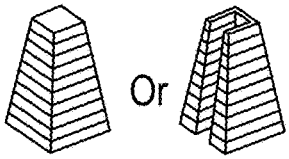

With reference to FIG. 7, processes of the method 600 of FIG. 6 are illustrated for example. As shown in FIG. 7, these processes include wafer preparation in step 1, deposition of positive/negative photoresists in step 2 and deposition of vanadium oxide, for example, in step 3. The processes further include lift off and layer completion in step 4, repetition of steps 2-4 in step 5 and final lift off in step 6.

Technical effects and benefits of the present disclosure are the provision of a metamaterial that exhibits low emissivity and high reflectiveness at relatively low temperatures and high emissivity at relatively high temperatures over large angle ranges (specifically for multiple polarizations and at grazing angles) thus allowing for self-cooling behavior.

The corresponding structures, materials, acts, and equivalents of all means or step-plus function elements in the claims below are intended to include any structure, material, or act for performing the function in combination with other claimed elements as specifically claimed. The description of the present disclosure has been presented for purposes of illustration and description, but is not intended to be exhaustive or limited to the technical concepts in the form disclosed. Many modifications and variations will be apparent to those of ordinary skill in the art without departing from the scope and spirit of the disclosure. The embodiments were chosen and described in order to best explain the principles of the disclosure and the practical application, and to enable others of ordinary skill in the art to understand the disclosure for various embodiments with various modifications as are suited to the particular use contemplated.

While the preferred embodiments to the disclosure have been described, it will be understood that those skilled in the art, both now and in the future, may make various improvements and enhancements which fall within the scope of the claims which follow. These claims should be construed to maintain the proper protection for the disclosure first described.

What is claimed is:

1. A hyperbolic metamaterial, comprising:
a substrate; and
sub-wavelength nanostructures arrayed on the substrate,
wherein each sub-wavelength nanostructure has a decreasing cross-sectional area with increasing height from the substrate and comprises:
dielectric or semi-metallic material layers; and
metal-insulator transition (MIT) material layers respectively interleaved with the dielectric or semi-metallic material layers, and
wherein each MIT material layer and each dielectric or semi-metallic material layer of each sub-wavelength nanostructure has a cross-sectional shape characterized in that current is induced in one or both of the dielectric or semi-metallic material layers and the MIT material layers by exposure to a magnetic field.

2. The hyperbolic metamaterial according to claim 1, wherein the hyperbolic metamaterial exhibits first emissivity and reflective behavior at first temperatures and second emissivity exceeding the first emissivity at second temperatures exceeding the first temperatures.

3. The hyperbolic metamaterial according to claim 1, wherein each MIT material layer and each dielectric or semi-metallic material layer of each sub-wavelength nanostructure has a split-C cross-sectional shape and each sub-wavelength nanostructure has a similar orientation.

4. The hyperbolic metamaterial according to claim 1, wherein each MIT material layer and each dielectric or semi-metallic material layer of each sub-wavelength nanostructure has a split-C cross-sectional shape and the sub-wavelength nanostructures have random orientations.

5. The hyperbolic metamaterial according to claim 1, wherein each MIT material layer and each dielectric or semi-metallic material layer of each sub-wavelength nanostructure has a horseshoe cross-sectional shape and each sub-wavelength nanostructure has a similar orientation.

6. The hyperbolic metamaterial according to claim 1, wherein each MIT material layer and each dielectric or semi-metallic material layer of each sub-wavelength nanostructure has a horseshoe cross-sectional shape and the sub-wavelength nanostructures have random orientations.

7. The hyperbolic metamaterial according to claim 1, wherein MIT material of the MIT material layers comprises at least one or more of vanadium oxide, tungsten oxide, titanium dioxide, molybdenum oxide, doped versions of vanadium oxide, tungsten oxide, titanium dioxide and molybdenum oxide, thermochromic materials that undergo a metal-insulator transition and combinations thereof.

8. A satellite, comprising:
a heat generating element; and
a hyperbolic metamaterial provided as a radiative structure disposed in thermal communication with the heat generating element, the hyperbolic metamaterial comprising:
a substrate; and
sub-wavelength nanostructures arrayed on the substrate,
wherein each sub-wavelength nanostructure has a decreasing cross-sectional area with increasing height from the substrate and comprises:
dielectric or semi-metallic material layers; and
metal-insulator transition (MIT) material layers respectively interleaved with the dielectric or semi-metallic material layers, and
wherein each MIT material layer and each dielectric or semi-metallic material layer of each sub-wavelength nanostructure has a cross-sectional shape characterized in that current is induced in one or both of the dielectric or semi-metallic material layers and the MIT material layers by exposure to a magnetic field.

9. The satellite according to claim 8, wherein the heat generating element comprises a satellite payload.

10. The satellite according to claim 8, wherein the hyperbolic metamaterial provided as the radiative structure is aimed in a preferential direction.

11. The satellite according to claim 8, wherein the hyperbolic metamaterial exhibits first emissivity and reflective behavior at first temperatures and second emissivity exceeding the first emissivity at second temperatures exceeding the first temperatures.

12. The satellite according to claim 8, wherein each MIT material layer and each dielectric or semi-metallic material layer of each sub-wavelength nanostructure has a split-C cross-sectional shape and each sub-wavelength nanostructure has a similar orientation.

13. The satellite according to claim 8, wherein each MIT material layer and each dielectric or semi-metallic material layer of each sub-wavelength nanostructure has a split-C cross-sectional shape and the sub-wavelength nanostructures have random orientations.

14. The satellite according to claim 8, wherein each MIT material layer and each dielectric or semi-metallic material layer of each sub-wavelength nanostructure has a horseshoe cross-sectional shape and each sub-wavelength nanostructure has a similar orientation.

15. The satellite according to claim 8, wherein each MIT material layer and each dielectric or semi-metallic material layer of each sub-wavelength nanostructure has a horseshoe cross-sectional shape and the sub-wavelength nanostructures have random orientations.

16. The satellite according to claim 8, wherein MIT material of the MIT material layers comprises at least one or more of vanadium oxide, tungsten oxide, titanium dioxide, molybdenum oxide, doped versions of vanadium oxide, tungsten oxide, titanium dioxide and molybdenum oxide, thermochromic materials that undergo a metal-insulator transition and combinations thereof.

17. A method of forming a hyperbolic metamaterial, the method comprising:

building up an array of sub-wavelength nanostructures on a substrate, wherein the building up of each sub-wavelength nanostructure comprises:

depositing a dielectric or semi-metallic material layer with a cross-sectional shape characterized in that current is induced in the dielectric or semi-metallic material layer by exposure to a magnetic field;

depositing a metal-insulator transition (MIT) material layer on the dielectric or semi-metallic material layer with a similar cross-sectional shape as the dielectric or semi-metallic material layer; and successively repeating the depositing of the dielectric or semi-metallic material layer and the depositing of the MIT material layer with each successive layer having a decreased cross-sectional area.

18. The method according to claim 17, wherein the cross-sectional shape and the similar cross-sectional shape is a split-C cross-sectional shape and the building up of each sub-wavelength nanostructure comprises orienting each sub-wavelength nanostructure similarly or at random.

19. The method according to claim 17, wherein the cross-sectional shape and the similar cross-sectional shape is a horseshoe cross-sectional shape and the building up of each sub-wavelength nanostructure comprises orienting each sub-wavelength nanostructure similarly or at random.

20. The method according to claim 17, wherein MIT material comprises at least one or more of vanadium oxide, tungsten oxide, titanium dioxide, molybdenum oxide, doped versions of vanadium oxide, tungsten oxide, titanium dioxide and molybdenum oxide, thermochromic materials that undergo a metal-insulator transition and combinations thereof.

* * * * *